US008777346B2

(12) United States Patent
Satou et al.

(10) Patent No.: US 8,777,346 B2
(45) Date of Patent: Jul. 15, 2014

(54) INK-JET PRINTING METHOD AND APPARATUS

(75) Inventors: Takashi Satou, Kanagawa (JP); Tomohiko Koda, Kanagawa (JP); Ryouta Matsufuji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

(21) Appl. No.: 13/572,991

(22) Filed: Aug. 13, 2012

(65) Prior Publication Data

US 2013/0038651 A1 Feb. 14, 2013

(30) Foreign Application Priority Data

Aug. 12, 2011 (JP) ..... 2011-177148
Jul. 11, 2012 (JP) ..... 2012-155412

(51) Int. Cl.
*B41J 29/38* (2006.01)
*B41J 2/045* (2006.01)

(52) U.S. Cl.
CPC ..... *B41J 2/04581* (2013.01); *B41J 2/04588* (2013.01)
USPC ..... 347/9; 347/10; 347/11

(58) Field of Classification Search
CPC ..... B41J 2/04581; B41J 2/04588
USPC ..... 347/9–12, 15
See application file for complete search history.

(56) References Cited

U.S. PATENT DOCUMENTS

2002/0073543 A1 6/2002 Koda et al.
2007/0195130 A1 8/2007 Koda et al.
2010/0328381 A1* 12/2010 Kuki et al. ..... 347/11
2010/0328400 A1 12/2010 Koda et al.

FOREIGN PATENT DOCUMENTS

JP 11-020158 1/1999
JP 2002-211011 7/2002

* cited by examiner

*Primary Examiner* — Shelby Fidler
*Assistant Examiner* — Tracey McMillion
(74) *Attorney, Agent, or Firm* — Harness, Dickey & Pierce, P.L.C.

(57) ABSTRACT

An ink-jet printing method includes the steps of dividing multiple ink droplet discharging pulses into two or more groups in an ink droplet discharging order, providing the multiple ink droplet discharging pulses to a pressure generator per scan line time, and discharging ink droplets from an ink droplet discharge head in accordance with the multiple ink droplet discharging pulses. The method further includes the steps of combining ink droplets of a former group as a first combined ink droplet, combining ink droplets of a latter group as a second combination droplet, combining the second combined ink droplet of the latter group with that of former group before the ink droplets reach a target, and maintaining a prescribed amount of ink droplets landing on the target by decreasing the number of ink droplet discharging pulses.

5 Claims, 11 Drawing Sheets

EACH OF START UP VOLTAGES OF EJECTION PULSES OF WAVEFORMS OF 15-DEGREE CENTIGRADE AND 20-DEGREE CENTIGRADE AND RATIO THERE BETWEEN

| | WAVEFORM OF 15-DEGREE CENTIGRADE | WAVEFORM OF 20-DEGREE CENTIGRADE | START-UP VOLTAGE OF WAVEFORM OF 20-DEGREE CENTIGRADE / START-UP VOLTAGE OF WAVEFORM OF 15-DEGREE CENTIGRADE (%) |
|---|---|---|---|
| P1 | 10.6 | 10.6 | 100% |
| P2 | 14.8 | 13.6 | 92% |
| P3 | 13.5 | 10.5 | 78% |
| P4 | 12.6 | 11.8 | 94% |
| P5 | 16.9 | 15.6 | 92% |

INK-JET PRINTING METHOD AND APPARATUS

CROSS-REFERENCE TO RELATED APPLICATIONS

This patent application is based on and claims priority pursuant to 35 U.S.C. §119 to Japanese Patent Applications Nos. 2011-177148 and 2012-155412, filed on Aug. 12, 2011 and Jul. 11, 2012, respectively, in the Japan Patent Office, the entire disclosure of which is hereby incorporated by reference herein.

BACKGROUND OF THE INVENTION

1. Field of the Invention

This invention relates to an ink-jet printing method and apparatus, and in particular to an ink-jet-printing method and apparatus that prints an image using an ink droplet discharge head.

2. Description of the Background Art

As an ink-jet-printer, a serial type printer that forms and prints an image by reciprocating a carriage incorporating an ink droplet discharge head, and an ink droplet-on-demand type printer that executes printing with an ink droplet ejection head aligned thereon are known.

In such ink-jet-printers, when a half tone image is printed, a common driving waveform formed from multiple driving signals (i.e., multiple driving pulses) is generated per printing cycle (or driving cycle), and one or multiple drive signals are chosen from the common driving waveform and applied to a pressure generator (for example, an actuator) that discharges ink droplets from the ink droplet discharge head. Specifically, by discharging the same or different sized ink droplets from the ink droplet discharge head and either combining these ink droplets during their flights or shooting multiple ink droplets at the same ink droplet landing position, dots of a different size are formed.

However, a problem is that density of ink and consequently a printing image varies in these ink-jet printers as ambient temperature changes. Therefore, a constant density has been demanded in the past regardless of the change in the ambient temperature, and various technologies have been developed to resolve such a problem.

For example, as described in Japanese Patent No. 3674248 (JP-3674248-B), in an ink-jet printer, a temperature range is divided into several groups and different multiple driving waveforms are assigned to each groups. Then, by changing the voltage in accordance with the change in temperature in each of the prescribed temperature groups, an image is printed with almost constant density regardless of the change of temperature.

Further, as described in Japanese Patent Application Publication No. 2002-211011 (JP-2002-211011-A), a dot diameter changing device is provided in an ink-jet printer to change the number of discharge ink droplets and accordingly a pixel dot size. Specifically, the diameter changing device changes the number of discharged ink droplets depending on the environment and equalizes the dot size.

Yet there are problem with the above-described printers. For example, with the ink-jet printer of JP-3674248-B, as described above a different driving waveform is obtained by changing the voltage in each of the divided temperature ranges. However, fine adjustment is needed to obtain the waveform assigned to each of the divided temperature ranges and accordingly requires a considerable time period. Further, the ink-jet printer of JP-2002-211011-A demonstrates a system in which a discharging ink droplet is added to a rear side of a previously discharged ink droplet. Thus, as it is discharged later the ink droplet velocity needs to be accelerated to catch up with and combine multiple preceding ink droplets with each other as a single ink droplet. Accordingly, when the number of ink droplets increases, a waveform producing the last ink droplet becomes significantly large. As a result, an ink meniscus is likely disturbed, resulting in unstable discharging of ink droplets as a problem.

BRIEF SUMMARY OF THE INVENTION

Accordingly, the present invention provides a novel ink-jet printing method implemented by an ink-jet printer. The method includes the steps of dividing multiple ink droplet discharging pulses into two or more groups in an ink droplet discharging order, providing the multiple ink droplet discharging pulses to a pressure generator per scan line time, discharging ink droplets from an ink droplet discharge head in accordance with the number of multiple ink droplet discharging pulses, combining ink droplets with each other successively discharged in accordance with the multiple ink droplet discharging pulses of a former group as a first combined ink droplet before the ink droplets reach a target, and combining ink droplets with each other successively discharged in accordance with the multiple ink droplet discharging pulses of a latter group as a second combined ink droplet before the ink droplets reach the target. The method further includes the steps of combining the second combined ink droplet with the first combined ink droplet before the ink droplets reach the target, and maintaining a prescribed amount of ink droplets landing on the target by decreasing the number of ink droplet discharging pulses by omitting the prescribed number of the ink droplet discharging pulses in the former group from the tail end thereof in accordance with temperature increase.

In another aspect of the present invention, an ink-jet printing method includes the step of maintaining a prescribed amount of ink droplets landing on the target by adjusting a discharge pulse located at the tail end of the former group in accordance with temperature increase.

In yet another aspect, the ink-jet printing method further includes the step of arranging a fine vibration pulse fine enough not to discharge an ink droplet but to vibrate an ink meniscus at a position where the ink droplet discharging pulse is omitted in the former group. An interval between the fine vibration pulse and a first pulse in the latter group substantially corresponds to a natural vibration cycle Tc determined depending on a condition of a passage of the ink droplet discharge head.

In yet another aspect, to maintain a prescribed amount of ink droplets landing on an target an ink-jet printer includes an ink droplet discharge head to discharge ink droplets, and a head drive controller to provide two or more successive groups of multiple ink droplet discharging pulses to the ink droplet discharge head in an ink droplet discharging order per scan line time to operate the ink droplet discharge head based on the multiple ink droplet discharging pulses. The ink-jet printer further comprises an ink droplet discharge controller to control the ink droplet discharge head to discharge and combine ink droplets with each other discharged based on the former group of the multiple ink droplet discharging pulses as a first combined ink droplet, and discharge and combine ink droplets with each other successively discharged based on the latter group of the multiple ink droplet discharging pulses as a second combined ink droplet. The ink droplet discharge controller further controls the ink droplet discharge head to combine the second combined ink droplet with the first combined ink droplet before the ink droplets reach the target. A pulse number adjuster is provided to decrease the number of discharging pulses by omitting the prescribed number of the multiple ink droplet discharging pulses from the tail end in the former group in accordance with temperature increase.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
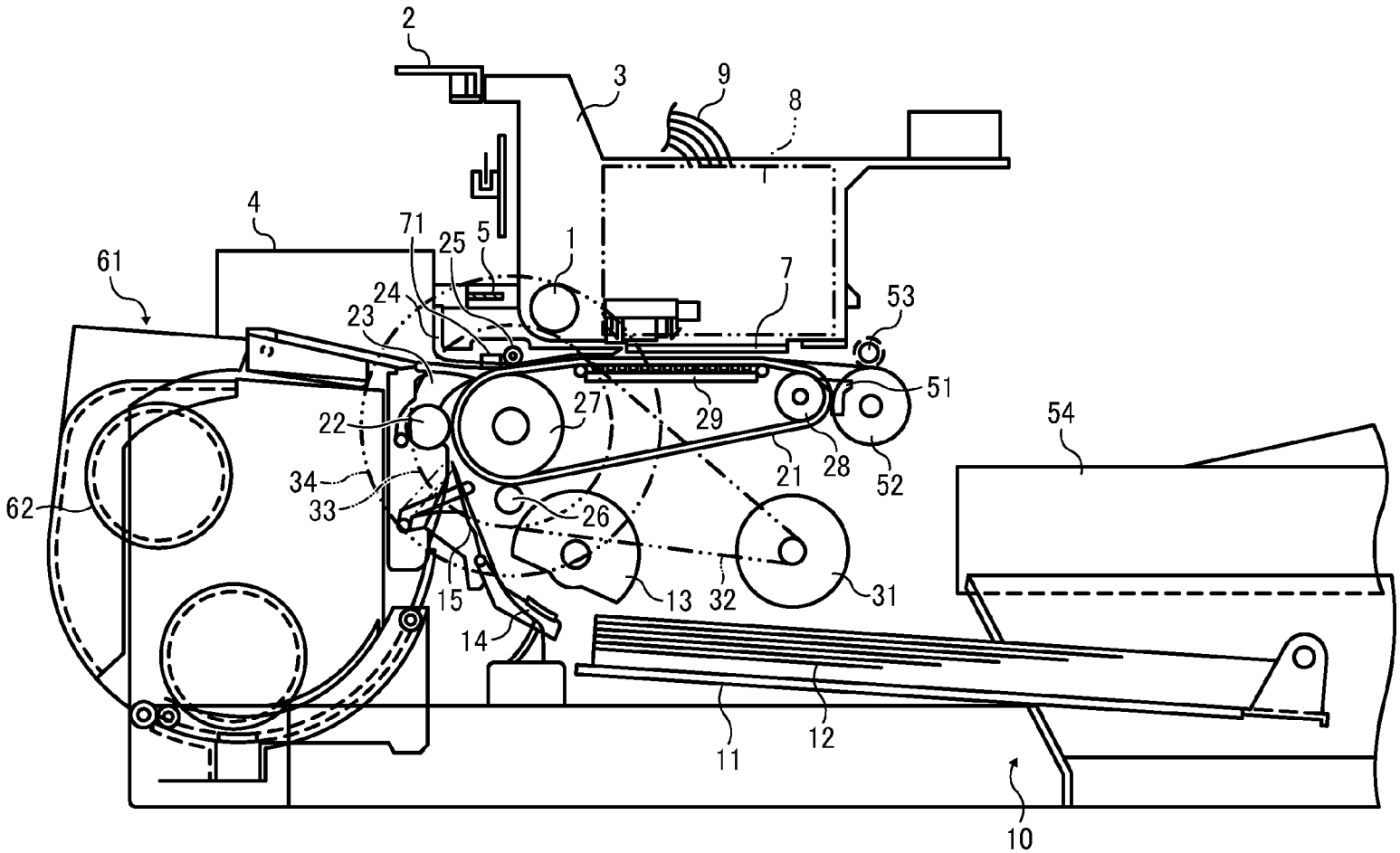
FIG. 1 is a side view illustrating a mechanism of an ink-jet printer according to an embodiment of execution of the present invention.
Figure 2:
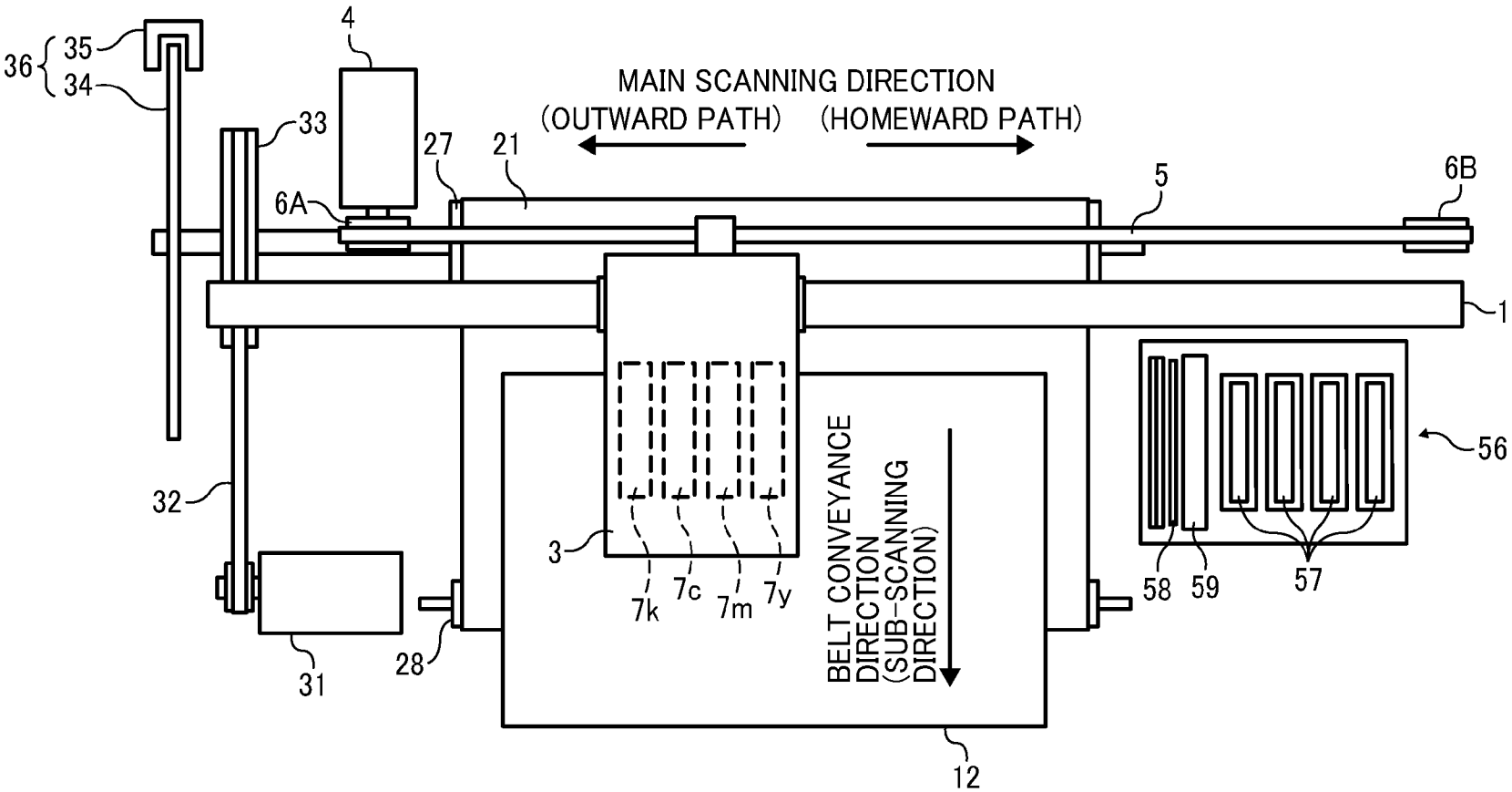
FIG. 2 is a plan view illustrating the mechanism shown in FIG. 1.

Referring now to the drawings, wherein like reference numerals designate identical or corresponding parts throughout the several views thereof and in particular to FIGS. 1 and 2 initially, a mechanism of an ink-jet printer is initially described. The ink-jet printer holds a carriage 3 slidable in a main scanning direction along a guide rod 1 and a guide rail 2 collectively serving as a guide unit supported by left and right side plates, not shown. The ink-jet printer moves the carriage 3 to traverse in a direction indicated by arrows in FIG. 2 (i.e., a main scanning direction) via a timing belt 5 stretched between a driving pulley 6A and a driven pulley 6B driven by a main scanning motor 4.

The carriage 3 accommodates four ink droplet discharge heads 7*y*, 7*c*, 7*k*, and 7*m*, which discharge ink droplets of yellow (Y), cyan (C), magenta (M), and black (K) (herein after referred to as "an ink droplet discharge head 7" when color is not identified"), respectively. Further, multiple ink ejection outlets of these four ink droplet discharge heads 7*y*, 7*c*, 7*k*, and 7*m* are arranged in a direction perpendicular to the main scanning direction to discharge these ink droplets downwardly.

In the carriage 3, multiple sub-tanks 8 for supplying multiple color inks to the ink droplet discharge heads 7 are installed, respectively. To the sub-tanks 8, ink is supplied from main tanks (for example, ink cartridges), not shown, via ink supply tubes 9, respectively. A sheet feeding unit is provided to feed a sheet 12 loaded on a sheet loading unit (for example, a pressure plate) 11, such as a sheet cassette 10, etc. The sheet loading unit includes a half-moon roller (i.e., a sheet feeding roller) 13 for separating and feeding the sheets 12 from the sheet loading unit 11 one by one, and a separation pad 14 made of material having a prescribed large coefficient of friction opposed to the sheet feeding roller 13. The separation pad 14 is biased toward the sheet feeding roller 13.

To electrostatically attract and transport the sheet 12 fed from the sheet feeding unit below the ink droplet discharge head, a conveyor belt 21 is provided. Further, a counter roller 12 is also provided to transport and sandwich the sheet 12 fed from the sheet feeding unit through the guide 15 in cooperation with the conveyance belt 21. Further included is a transportation guide 23 for turning a sheet 12 almost vertically and upwardly by the angle of about 90 degrees and bringing it to contact the conveyor belt 21. Yet further included is a pressing roller 25 biased by a pressing member 24 toward the conveyor belt 21. A discharging roller 26 is provided as a charger to charge a surface of the conveyor belt 21.

The conveyor belt 21 is an endless type and is stretched between a conveyance roller 27 and a tension roller 28. The conveyor belt 21 thus circulates in a belt conveying direction (i.e., a sub-scanning direction) as shown in FIG. 2 when a conveyance roller 27 is rotated by the scanning motor 31 via a timing belt 32 and a timing roller 33. On the back side of the conveyance belt 21, a guide 29 is arranged opposed to an image formation region for the ink droplet discharge head 7. The discharging roller 26 is arranged contacting a surface of the conveyor belt 21 and is driven and rotated by circulation of the conveyor belt 21.

Further, a slit disc 34 is attached to a shaft of the conveyance roller 27 as shown in FIG. 2. An encoder sensor 35 is provided to detect a slit formed in the slit disc 34. The slit disc 34 and encoder sensor 35 collectively constitute a rotary encoder 36. In addition, as a sheet ejection unit for ejecting sheets 12 while bearing an image printed by the ink droplet discharge head 7, a separation pawl 51 and a pair of sheet ejection rollers 52 and 53 are provide to separate and eject the sheet 12 from the conveyance belt 21. Further, a sheet ejection tray 54 is also provided to store an ejected sheet 12.

In a back side of the printer, a duplex sheet feed unit 61 is detachably attached. The duplex sheet feed unit 61 captures the sheet 12 returned by reverse rotation of the conveyor belt 21 in a reverse direction, turns the sheet 12 upside down, and further feeds it again into a gap between the conveyance belt 21 and the counter roller 22. As shown in FIG. 2, at one end of a non-printing area in the main scanning direction of the carriage 3, there is provided a maintenance mechanism 56 to maintain each of nozzles of the ink droplet discharge head 7 in optimum condition.

The maintenance mechanism 56 includes caps 57 for capping nozzle surfaces of the ink droplet discharging head 7, respectively. Further included in the maintenance mechanism 56 is a wiper blade 58 as a blade for wiping surfaces of the nozzles. Yet further included in the maintenance mechanism 56 is an trial ink discharge receiver 59 to receive ink droplets during an trial ink droplet discharge process of discharging ink droplets to drain those having increased viscosity not contributing to the printing.

In such an ink-jet printer, the sheets 12 are separated and fed one by one from the sheet feeder. The sheet 12 is then almost vertically fed upwardly, and is guided by a guide 15, and is then conveyed and sandwiched between the conveyance belt 21 and the counter roller 22. A leading end of the sheet 12 fed in this way is further guided by a transportation guide 23 and is pressed by the pressing roller 25 against the conveyor belt 21, so that a direction of conveyance thereof is changed by the angle of about 90°.

An alternating voltage, in other words, a voltage that repeatedly alternates between positive and negative, is provided to the discharging roller 26 from an AC bias supply unit under control of the controller unit 200 as described later in detail with reference to FIG. 4. Thus, the conveyor belt 21 comes to bear a charge voltage alternating pattern, which includes multiple belt-like portions each having a given width alternately bearing positive and negative voltages at a prescribed interval in the sub-scanning direction of a circulation direction thereof. Thus, when it is fed onto the conveyor belt 21 alternately charged in positive and negative states, the sheet 12 is absorbed onto the conveyor belt 21 due to an electrostatic force generated thereon, and is conveyed in the sub-scanning direction as the conveyor belt 21 circulates.

Then, the ink droplet discharge head 7 is operated in accordance with an image signal while moving the carriage 3 both in forward and homeward directions, so that the ink is ejected onto the sheet 12 stopping on the belt. When printing for one line is completed, the sheet 12 is further conveyed by a prescribed distance, so that the next line is printed. By receiving either a printing completion signal or a signal representing that a trailing edge of the sheet 12 reaches a printing area, the printing is completed and the sheet 12 is ejected onto the sheet ejection tray 54.

When duplex printing is executed and printing onto a front surface (i.e., a first printing surface) is completed, the conveyor belt 21 is reversely circulated and the sheet 12 with a printed image on it one side is thereby transported toward a duplex sheet feed unit 61. The sheet 12 is then reversed (i.e., a back side serves a printing surface) and is again transported between the conveyance belt 21 and the counter roller 22. The sheet 12 is subsequently transported onto the conveyor belt 21 at a prescribed time as described earlier and receives a printing image on its back side. The sheet 12 then exits onto the sheet ejection tray 54.

Further, the carriage 3 is moved to the maintenance mechanism 56 during a print waiting stage, and the caps 57 cap the nozzle surfaces of the ink droplet discharging heads 7, respectively, to prevent defective ink discharging, which is generally caused by dry ink, by maintaining a wet condition thereof. At the same time, ink is sucked (herein after referred to as a "head suction" or a "nozzle suction") from each of the nozzles to perform a recovery operation to drain viscosity-increased (i.e., thickened) ink together with an air bubble while capping the ink droplet discharge heads with the caps 57, respectively. To clean and remove the ink adhered to the nozzle surface of the ink droplet discharge head 7 during the above-described recovery operation, the wiper blade 58 provides wiping to the same. Before and/or midst of the printing, the trial discharge operation for discharging ink not contributing to the printing is executed. Consequently, this maintains a stable discharge performance of the ink droplet discharging head 7.

Figure 3:
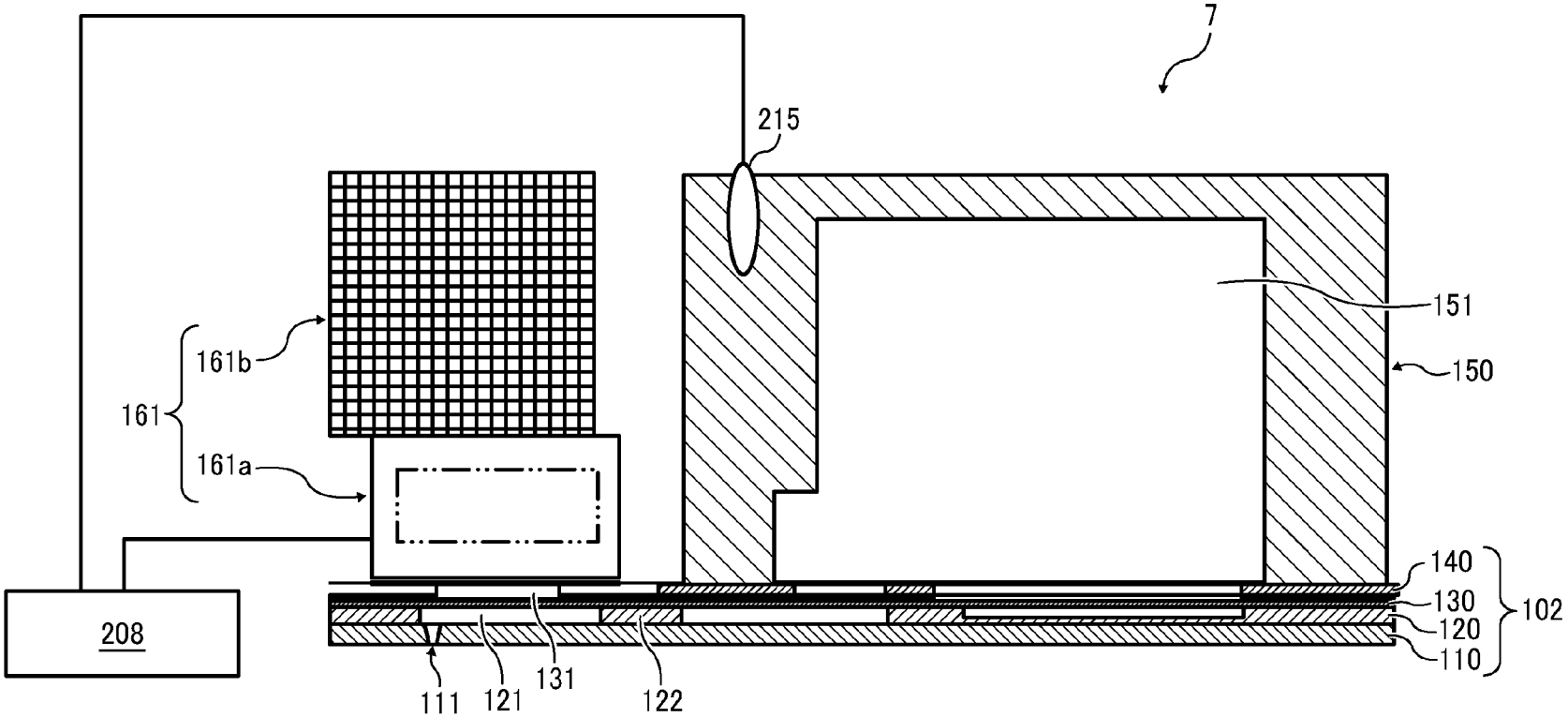
FIG. 3 is a cross-sectional view illustrating an ink droplet discharge head used in an ink-jet printing method and an ink-jet printer in one embodiment.

Now, the ink droplet discharge head 7 is described more in detail with reference to FIG. 3, which is a cross-sectional view thereof. As shown, the ink droplet discharge head 7 employs a piezoelectric transducer 161*a*, and mainly includes a flow channel substrate 102, a frame 150, and a pressure generator (for example, a piezoelectric element) 161. The flow channel substrate 102 includes a nozzle plate 110 having multiple nozzle openings 111 perpendicular to the drawing, a nozzle pressure chamber 121 communicating with the multiple nozzle openings 111, and a restrictor plate 120 having a fluid resistance unit 122 that controls an amount of ink flown into the pressure chamber 121. Further included are a diaphragm plate 130 having a vibration plate 131 to effectively convey pressure from the pressure generator 161 to the pressure chamber 121, and a manifold plate 140 that separates current of the ink in the common ink chamber 151 to each of the nozzle openings 111.

The frame 150 holds the flow channel substrate 102 and includes a common ink chamber 151 to take in and reserve ink provide from an outside with its opening facing the manifold plate 140. In the pressure generator 161, one end of the piezoelectric element 161 (a piezoelectric vibrator 161*a*) formed by alternately stacking piezoelectric material and conductive material is firmly attached to a supporter 161*b* with its other end being glued to the diaphragm plate 130 with adhesive. An electrode is formed on the piezoelectric element 161 and is electrically connected to a drive control unit (for example, a head driver) 208 (see, FIG. 4). Here, reference numeral 215 denotes a temperature sensor, for example, a thermistor, to sense temperature of the head.

The ink is supplied via an ink supply tube or a head connection tube, not illustrated, and enters the common ink chamber 151. The ink is further flown through the manifold plate 140, the fluid resistance unit 122, the pressure chamber 21, and the nozzle opening 111, sequentially. When a given driving pulse is applied from the head driver 208 described later in detail with reference to FIG. 4 to it, the piezoelectric element 161 extends and shrinks. Whereas when the pulse application is stopped, the piezoelectric element 161 returns to an original state. With such deformation of the piezoelectric element 161, pressure is momentarily applied to the ink 121 stored in an individual liquid chamber (i.e., a pressure chamber), and the ink generates an ink droplet and lands on an adhesion medium from the nozzle opening 111.

The ink droplet discharge head 7 has a natural vibration cycle Tc, so called a Helmholtz-cycle, which is controlled by a compliance (i.e., a reciprocal of spring constant) determined by shapes of the nozzle opening 111, the fluid resistance unit 122, and the pressure chamber 121 or the like (i.e., devices arranged between the nozzle opening 111 and the fluid resistance unit 122), and an inertance (i.e., $\rho L/S$, wherein $\rho$ represents a gas density, L represents a length, and S represents a cross sectional area).

Figure 4:
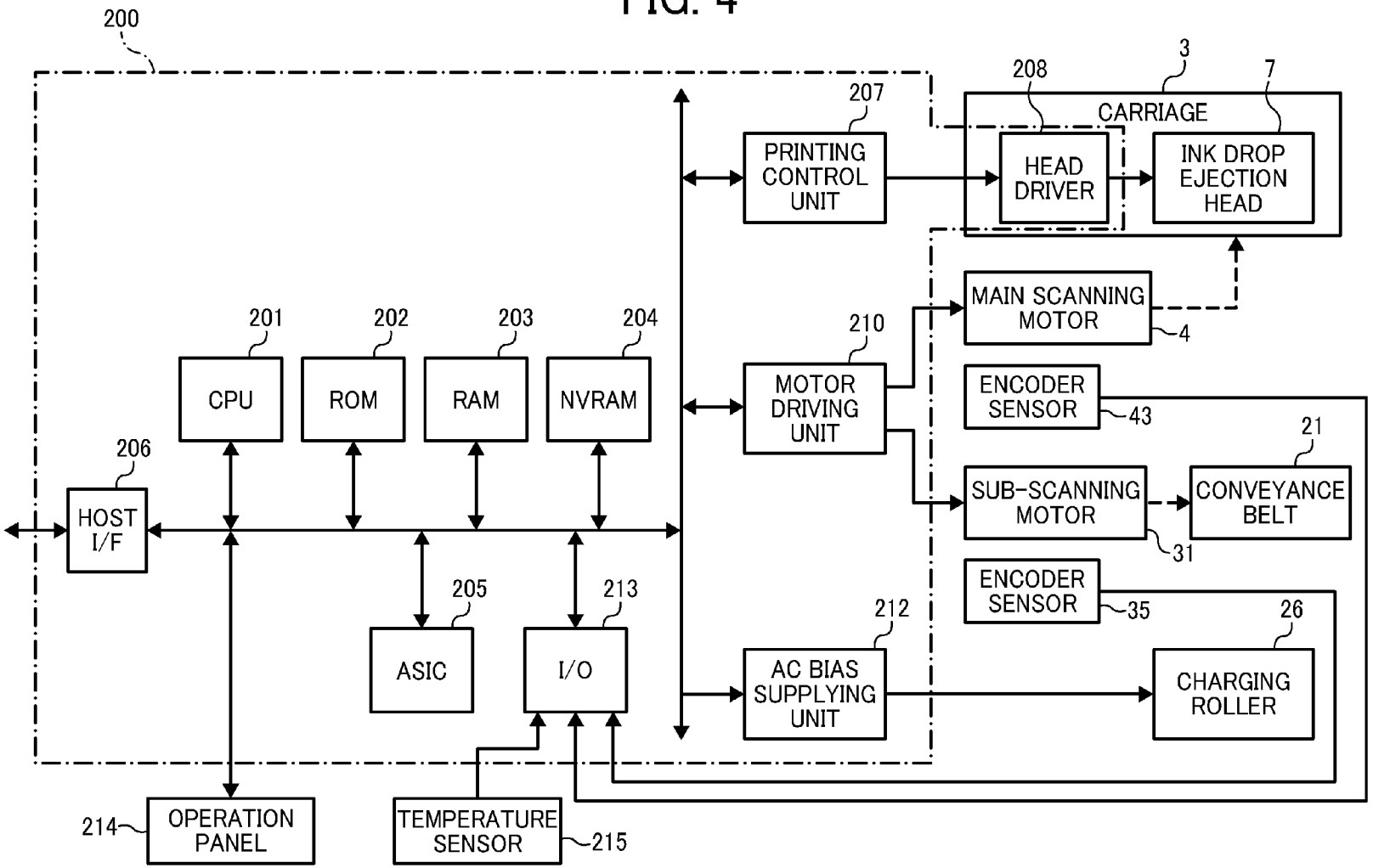
FIG. 4 is a block diagram showing a summary of a control unit provided in the ink-jet printer according to one embodiment.

Now, an overview of the control unit of the ink-jet printer according to one embodiment of the present invention is given with reference to the block diagram of FIG. 4. The control unit 200 has a CPU (Central processing Unit) 201 to generally control the printer, a ROM (Read Only Memory) 202 that contains program to be read and implemented by the CPU 201 and other static data, and a RAM (Random Access Memory) 203 that temporarily stores image data or the like.

The control unit 200 has a CPU (Central Processing Unit) 201 that controls the printer as a whole, a ROM (Read-Only Memory) 202 that contains programs to be read and implemented by the CPU 201 and other static data, and a RAM (Random Access Memory) 203 that temporarily stores image data or the like. The control unit 200 further has a rewritable NV-RAM (Non-Volatile Memory) to hold data even when power is out and an ASIC (Application Specific Integration Circuit) 205 to handle various signals for image data and input/output signals to control the entire unit and execute image processing, such as sorting, etc.

The control unit 200 also includes a host I/F (Interface) 206 that conducts data and signal communications with a host side, a data transfer device that drives and controls the ink droplet discharge head 7, and a printing control unit 207 including a driving waveform generator to generate a unique driving waveform according to various embodiments of the present invention as described later. The control unit 200 further includes a head driver (for example, a driver IC (Integration Circuit)) 208 disposed on a side of the carriage 3 to drive the ink droplet discharge head 7, a motor-driving unit 210 that drives main and sub-canning motors 4 and 31, and an AC (Alternating Current) bias supply unit 212 to supply an AC bias to the discharging roller 26. The control unit 200 also has an I/O (Input/Output) device 213 to receive various detection signals from encoder sensors 43 and 35 and other sensors, such as a temperature sensor 215, etc., that detects environment temperature or the like. An operation panel 214 is connected to the control unit 200 to input and display information necessary for the printer.

The control unit 200 receives print data or the like from the host side, i.e., an information processing deice, such as a personal computer, etc., an image reader, such as an image scanner, etc., and an imaging device, such as a digital camera, etc., via an Internet or a cable system at a host I/F 206.

Then, the CPU 201 of the host control unit 200 reads and analyses the print data included in the host I/F 206, executes image processing and sorts data or the like. The CPU 201 then transfers such image data from the print control unit 207 to the driver head 208. Here, a printer driver employed in the host-side generates dot pattern data for outputting an image.

The printing control unit 207 transfers the above-described image data serially, and at the same time outputs a transfer clock and a latch signal needed in transferring and latching the image data, and an ink droplet control signal (for example, a mask signal) as well to the head driver 208. The printing control unit 207 includes a driving waveform generation sub-unit mainly consisting of a D/A (Digital to Analog) converter for applying D/A conversion to pattern data of a drive signal stored in the ROM, a voltage amplifier, and a current amplifier. The printing control unit 207 also includes a driving waveform selector for selectively providing a driving waveform to the head driver 208, and a driving waveform generator that generates a driving waveform mainly composed of one or more driving pulses (i.e., driving signals), thereby outputting the driving waveform to the head driver 208. The above-described driving waveform selector also functions to decrease the number of discharge pulses as a pulse number adjuster.

The head driver 208 selectively provides a driving signal constituting a driving waveform given from the printing control unit 207 to a driving element (for instance, a piezoelectric element), which generates energy capable of discharging ink droplets from the ink droplet discharge head 7, corresponding to serially inputted image data for one line of the ink droplet discharge head 7, thereby driving the ink droplet discharge head 7. By selectively applying a prescribed driving pulse that constitutes the driving waveform, a dot having a different size, such as a large ink droplet, a medium-size ink droplet, a small ink droplet, etc., can be separately shoot, for example.

Further, the CPU 201 samples a detection pulse from the encoder sensor 43 constituting a linear encoder, obtains velocity detection and position detection values, and calculates a driving output value (i.e., a control value) to be outputted to the main scanning motor 4 based on position target and velocity target values obtained from velocity and position profiles previously stored. The CPU 201 then drives the main scanning motor 4 via a motor drive unit 210. Similarly, the CPU 201 samples a detection pulse from the encoder sensor 35 constituting the rotary encoder 36 (see FIG. 2), obtains velocity detection and position detection values, and calculates a driving output value (i.e., a control value) to be outputted to the sub-scanning motor 31 based on position target and velocity target values obtained from velocity and position profiles previously stored. The CPU 201 then drives the sub-scanning motor 31 through a motor driver and the motor drive unit 210.

Figure 5:
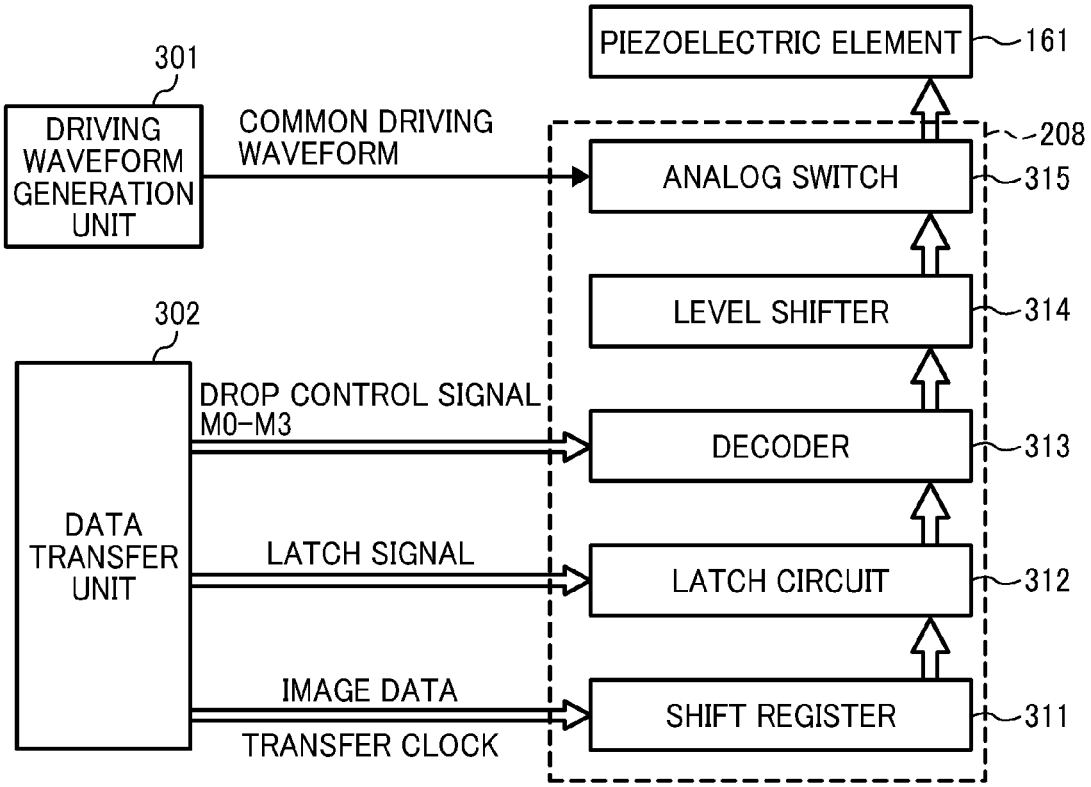
FIG. 5 is a chart illustrating one example of a printer control unit and a head driver provided in the control unit of FIG. 4.

Now, one example of the printing control unit 207 and the head driver 208 is described with reference to FIG. 5. The printing control unit 207 has a driving waveform generation unit 301 that generates and outputs a driving waveform (for example, a common driving waveform) mainly consisting of multiple driving pulses (for example, driving signals) per printing cycle as mentioned earlier, and a data transfer unit 302 that outputs image data of two-bit (i.e., gradation signals 0 and 1) corresponding to a print image, a clock signal, a latch signal (LAT), and ink droplet control signals M0 to M3.

Further, the ink droplet control signal is a 2-bit signal that instructs an analog switch 315, which is a switching means of a head driver 208 described later in detail to open or close at every ink droplet. In sync with the common driving waveform print cycle, the ink droplet control signal to a high level (ON) with a print cycle of the common driving waveform, and shifts to a low level (OFF) when it is not chosen.

The head driver 208 includes a shift register 311 receiving inputs of a transfer clock (for example, a shift clock) and serial image data (for example, gradation data of two bits/CH) from the data transfer unit 302, and a latch circuitry 312 that latches each of registration values of the shift register 311 based on a latch signal, a decoder 313 that decodes gradation data and ink droplet control signals M0 to M3 and outputs a decoding result. The head driver 208 further includes a level shifter 314 that converts a logical voltage signal of the decoder 313 into an analog signal, and the analog switch 315 to be turned on and off (i.e., open and close) by an output of the analog signal from the decoder 313 through the level shifter 314.

The analog switch 315 is connected to each of selection electrodes (for example, separate electrodes) in the piezoelectric elements 161 to input a common driving waveform received from the driving waveform generation unit 301 thereto. Therefore, when the analog switch 315 is turned on in accordance with serially transferred image data (for example, gradation data) and a result of decoding the ink droplet control signals M0 to M3 by the decoder 313, a prescribed driving signal constituting the common driving waveform passes therethrough (i.e., it is selected) and is provided to the piezoelectric element 161.

Figure 6:
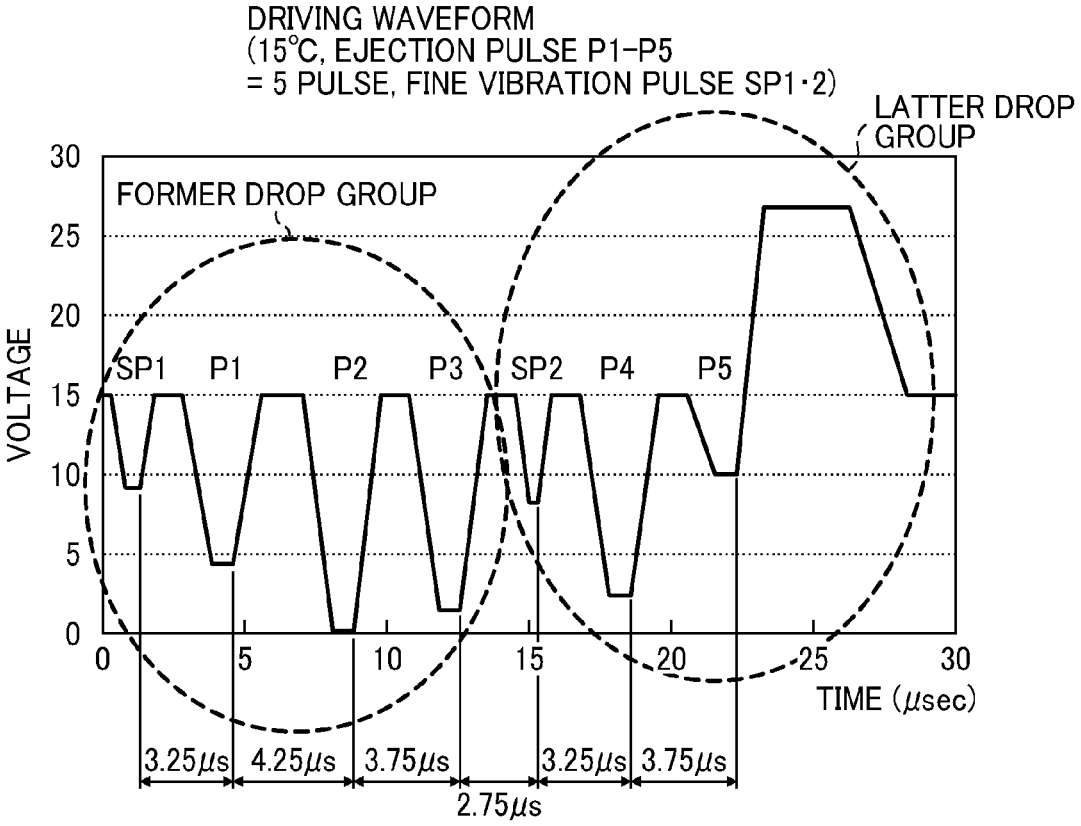
FIG. 6 is a chart showing a driving waveform utilized in controlling the ink droplet discharge head when ambient temperature low (for example, 15° C.) according to one embodiment.

Now, an ink discharge control system employed in an ink-jet printer to almost maintain a prescribed amount ink droplets even when temperature changes is described according to one embodiment of the present invention. In short, ink discharge control is executed by changing a waveform to be applied to the ink droplet discharge head 7 in accordance with temperature as described below. Specifically, as shown in FIG. 6, one example of a driving waveform is utilized in the ink droplet discharge head 7 when environment temperature is low as 15° C. as one example of this embodiment.

In general, a Helmholtz cycle of the ink droplet discharge head 7 is determined based on a structure of an individual liquid chamber (for example, a pressure chamber) 121 of the head, and is approx. 3μ in this embodiment. Further, as shown there, five discharge pulses P1 to P5 and two fine vibration pulses SP1 to SP2 not discharging an ink droplet, totally seven pulses, are provided to the ink droplet discharge head 7 of the ink jet printer per printing cycle.

Each of the driving pulse increases a volume of the pressure chamber 121 at a voltage descending portion and holds its condition for a prescribed time period, and decreases the volume thereof at a voltage rising portion, thereby discharging ink droplets. Thus, a so-called pulling and shooting type waveform is employed. Here, by adjusting a voltage of a driving pulse applied to the ink droplet discharge head 7, an ink droplet velocity is changed. For example, by increasing a voltage of the driving pulse, the velocity of ink droplet can be increased. Therefore, by adjusting the voltage of the driving pulse and a time interval between the driving pulses, an ink droplet discharged later can catch up and is combined with an ink droplet previously discharged before the previous ink droplet reaches an adhering medium, such as a printing sheet, etc.

Now, a process of coalescence (i.e., combination) of discharged ink droplets is described with reference to FIG. 7, wherein voltages of driving pulses and a time interval between the driving pulses are controlled so that the coalescence of the ink droplets occurs during their flight according to this embodiment. Initially, a first ink droplet is discharged by a driving pulse P1 of FIG. 6 in step (i). Next, a second ink droplet is discharged by a driving pulse P2 in step (ii). By increasing a velocity of the second ink droplet more than the first ink droplet, the first and second ink droplets are united to each other during their flights as a combination droplet in step (iii). Further, by discharging a third ink droplet with a yet faster ink droplet velocity based on a driving pulse P3, the third ink droplet catches up and is combined with the combination droplet of the first and second ink droplets. Subsequently, a driving pulse P4 discharges a fourth ink droplet in step (iv). An ink droplet velocity of the fourth ink droplet is controlled to be slower than the third ink droplet. Subsequently, before the fourth ink droplet combines with the combination droplet of the first to third ink droplets, a fifth ink droplet is discharged by a driving pulse P5 in step (v). The fifth ink droplet is united to the fourth ink droplet thereby causing a combined ink droplet of the fourth and fifth ink droplets in step (vi).

Thus, according to this embodiment, the combined ink droplet of the first to third ink droplets is initially formed as a former ink droplet group, and the combined ink droplet of the fourth and fifth ink droplets is formed later as a latter ink droplet group up to step (vii). Then, the former ink droplet group of the first to third ink droplets and the latter ink droplet group of fourth and fifth ink droplets coalesce and a combined ink droplets of the first to fifth droplets finally lands on the adhering medium in step (ix).

Figure 7:
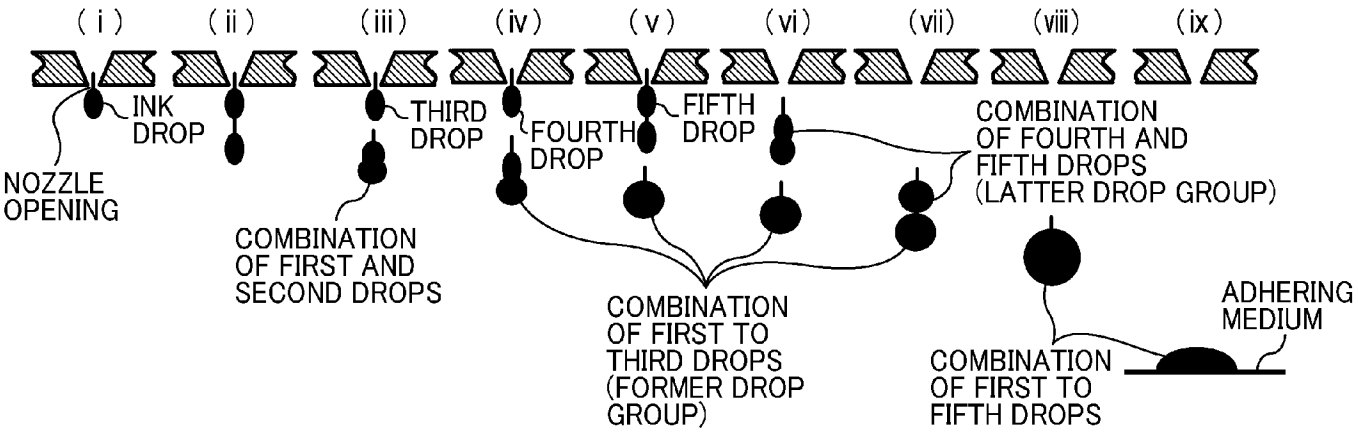
FIG. 7 is a diagram that illustrates a process when ink droplets fly and coalesce.
Figure 8:
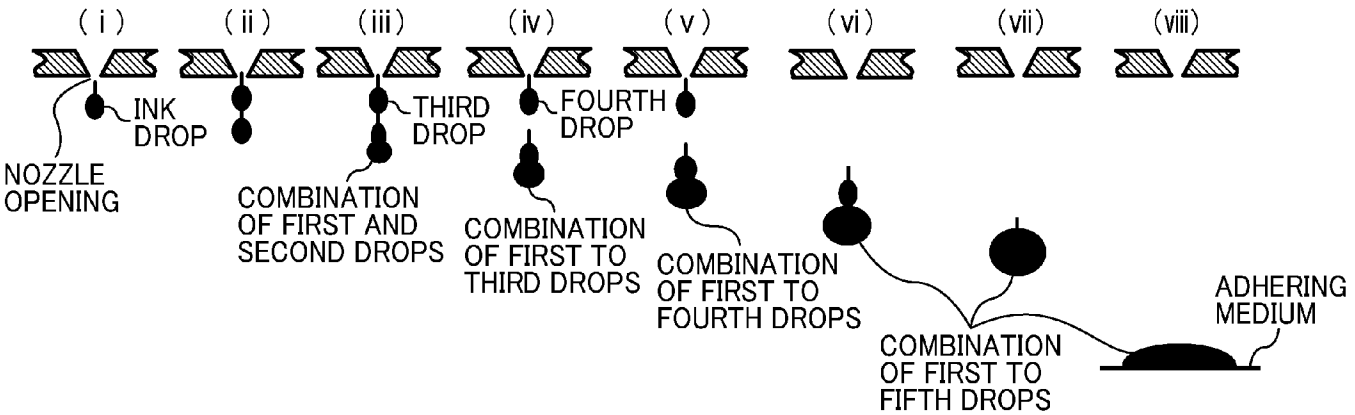
FIG. 8 is a chart indicating a typical process of coalescence of ink droplets to be compared with that of one embodiment.

FIG. 8 is a diagram showing a typical process of coalescing ink droplets from when an ink droplet is discharged and repeats combination of the ink droplets to when they land on the adhering medium to be compared with a process of this embodiment of FIG. 7. As shown, a velocity of an ink droplet is increased in proportion to a discharging order in FIG. 7. In this embodiment of FIG. 7, however, the process of increasing a velocity of an ink droplet in proportion to a discharging order as shown in FIG. 8 is not employed. Therefore, the velocity of discharging the later ink droplet does not need to be significantly increased in this embodiment as different from the process of FIG. 8. Thus, an ink discharging process can be stable, because a meniscus does not largely vibrate in comparison with a situation where the process of FIG. 8 is executed.

Further, in FIG. 8, an ink droplet later discharged successively combines with an ink droplet previously discharged in the coalescence process of the ink droplets as described below. A first ink droplet is initially discharged by a driving pulse in step (i). Next, a second ink droplet is discharged by the next driving pulse in step (ii). By increasing a velocity of the second ink droplet more than the first ink droplet, the first and second ink droplets are united to each other as a combined ink droplet during their flight. Further, by discharging a third ink droplet with a yet faster ink droplet velocity, the third ink droplet catches up and is combined with the combined ink droplet of the first and second ink droplets in step (iii). Subsequently, by discharging a fourth ink droplet with a yet faster ink droplet velocity, the fourth ink droplet catches up and is combined with the combined ink droplet of the first to third ink droplets in step (iv). Then, by discharging a fifth ink droplet with a yet fastest ink droplet velocity in step (v), the fifth ink droplet catches up and combines with the combined ink droplet of the first to fourth ink droplets in step (vi). The combined ink droplet of the first to fourth ink droplets thereby has a large size in step (vii), and the combined ink droplet of the first to fifth ink droplets finally lands on the adhering medium in step (viii).

Specifically, in the coalescing process of the ink droplets of FIG. 8, the former and latter ink droplets are combined during their flights by increasing the discharging velocity of the latter ink droplet by a greater velocity than the discharging velocity of the former ink droplet. Accordingly, when the number of ink droplets increases, the end of the ink droplet almost needs a considerably fast discharge velocity. As a result, the meniscus becomes unstable resulting in unstable discharging of the ink droplets. By contrast, according to this embodiment of FIG. 7, multiple ink droplets are separated into two or more groups as shown in FIG. 7, and ink droplets are combined with each other in each of former and latter ink droplet groups separately, and these groups are ultimately united thereafter into a single ink droplet. Accordingly, the meniscus is stable even though the ink droplets are combined as different from the process of FIG. 8.

Further, because viscosity of ink also changes when temperature changes, a voltage of a driving pulse needs to be changed in accordance with a change in ambient temperature to obtain a constant ink droplet velocity. For example, when the driving pulse of FIG. 6 is supposed to be a low temperature use waveform, an ink droplet velocity needs to be adjusted by decreasing a voltage of the driving pulse when the ink droplet is discharged at high ambient temperature. However, an amount of the ink droplets increases as temperature goes up even if an ink droplet velocity is the same. Thus, even though the ink droplet velocity is adjusted to be suitable for low temperature, the amount of ink droplets unfortunately increases as temperature increases. For example, the amount of ink droplets increases by about 2-pl, which corresponds to a single discharge pulse, when temperature is 35° C. from when it is 15° C.

Figure 9:
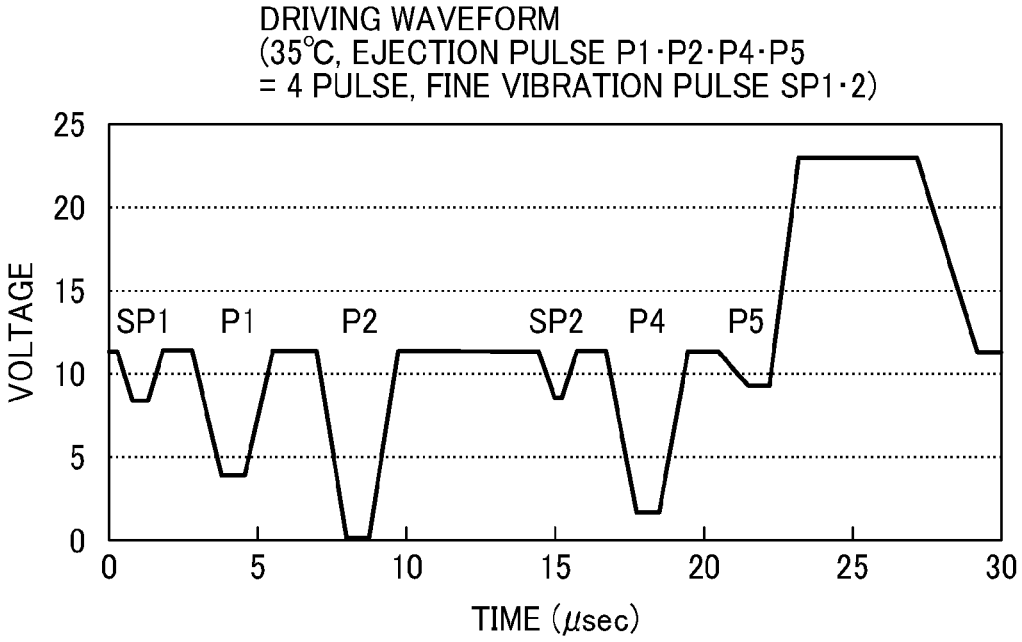
FIG. 9 is a diagram showing a driving waveform utilized in controlling the ink droplet discharge head when ambient temperature is high (for example, 35° C.) according to one embodiment.

Then, according to another embodiment of the present invention, a prescribed driving waveform is utilized and is provided to the ink droplet discharge head 7 when temperature is high as 35° C. as shown FIG. 9. Specifically, a waveform corresponding to the pulse P3 of FIG. 6 is removed and only four pulses P1, P2, P4, and P5 remains to obtain approximately the same amount of ink droplets when the temperature is 35° C. as when it is 15° C. The pulse P3 is removed because it slightly applies an impact on the latter ink droplet group. That is, since the pulse P3 is located at the end of the former ink droplet group, an impact of presence or absence thereof on a change in velocity a combined droplet is week. Further because, since the latter ink droplet group independently soars from the former ink droplet group and is ultimately united to the former ink droplet group, an impact thereof on the latter ink droplet group is again week.

Figure 10:
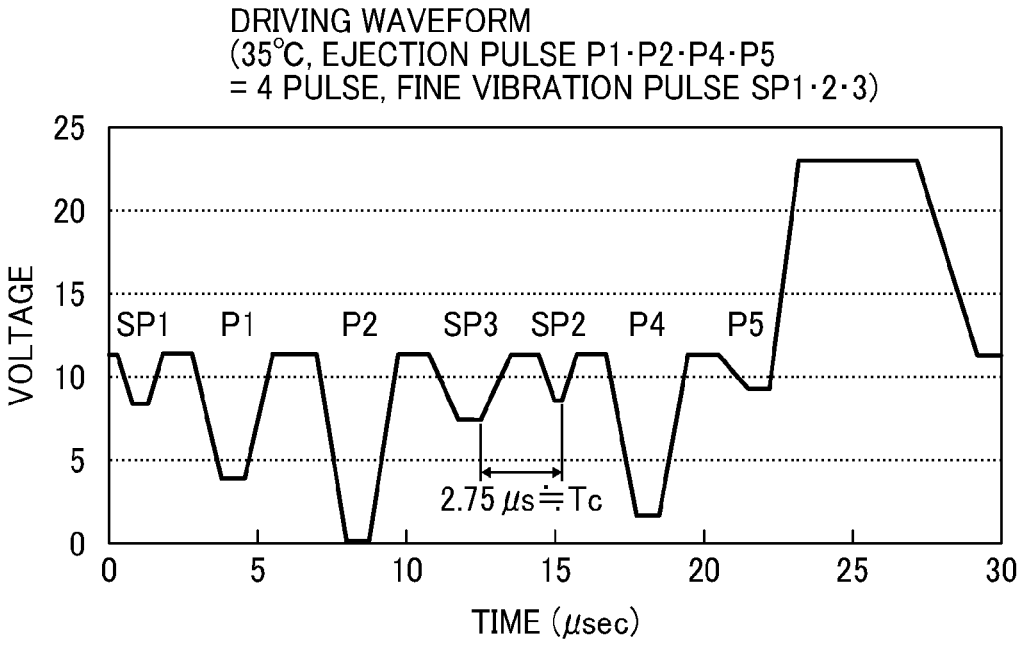
FIG. 10 is a diagram showing another driving waveform utilized in controlling the ink droplet discharge head when ambient temperature is high (for example, 35° C.) according to one embodiment.

Further, beside that the discharge pulse of the end of the former ink droplet group is simply removed from the driving waveform of FIG. 9 when ambient temperature is high as 35° C., a micro-vibration pulse SP3 may be additionally placed at a position (on a time axis) where the above-described discharge pulse P3 is omitted to vibrate an ink meniscus without discharging ink therefrom as shown FIG. 10. Specifically, another driving waveform is employed and is provided to the ink droplet discharge head 7 when ambient temperature is high as 35° C. That is, a cycle (i.e. a disposition) of the fine vibration pulse SP3 is determined so that a pulse interval between the fine vibration pulse SP3 and a micro-vibration leading pulse SP2 in the latter ink droplet group is almost equivalent to the Helmholtz cycle Tc (3 μs) of the ink droplet discharge head 7. For example, the pulse interval is about 2.75 μs in this embodiment as shown in the drawing. As a result, an ink droplet velocity of the latter ink droplet group becomes faster, and coalescence thereof with the former ink droplet group can be ensured.

That is because, even though residual vibration caused by the previous waveform gradually decreases, an impact thereof almost firstly disappears when more than 3 Tc (i.e., 9 μs) has elapsed after discharging the ink droplet. Therefore, when a driving pulse interval is almost equivalent to a pitch of the Helmholtz cycle Tc, a vibration caused by a former waveform is superimposed on a vibration caused by a waveform of the first driving pulse P4 in the latter ink droplet group. As a result, substantially the same result can be obtained as if a high voltage is applied in a first waveform of the latter ink droplet group.

Thus, when a required accuracy of an amount of ink droplets corresponds to approximately one pulse, a discharge pulse of the end of the former ink droplet group is simply omitted as described above. However, when closer precision is required, a waveform of a discharge pulse of the tailing end of the former ink droplet group is adjusted. For example, since when temperature is 20° C., an amount of increase in ink droplet is considerably smaller than that corresponding to a single discharge pulse (of the 15° C. use waveform). Thus, if the number of discharge pulses is decreased by one, a quantity of ink droplets may be insufficient in such ambient temperature. Then, the amount of ink droplets is adjusted by appropriately utilizing a discharging pulse P3 located at the end of the former ink droplet group as shown in FIGS. 11A and 11B.

Figures 11A, 11B:
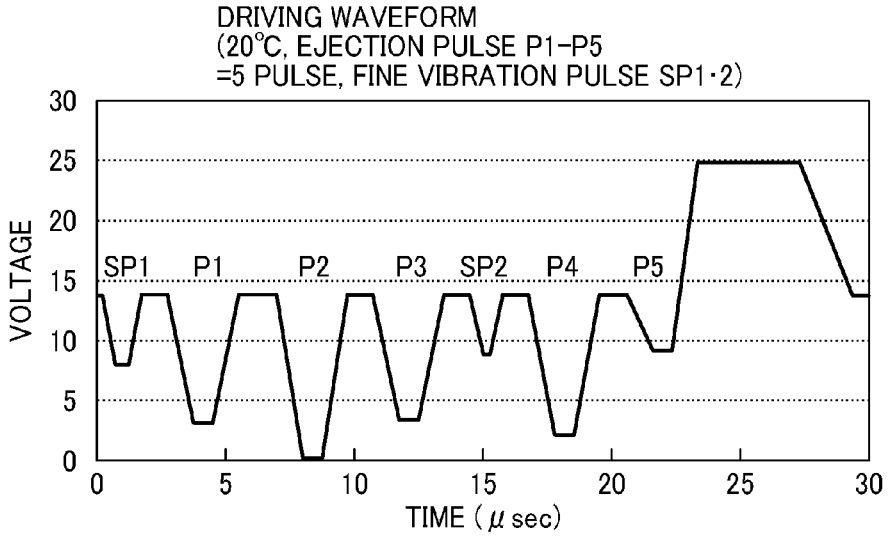
FIG. 11A is a chart illustrating a driving waveform utilized in controlling the ink droplet discharge head when ambient temperature is 20° C. according to one embodiment.
FIG. 11B is a chart representing rising voltages of discharging pulses of 15° C. and 20° C. waveforms, respectively, and a ratio between the voltages of those.

Specifically, FIG. 11A indicates a driving waveform to be provided to the ink droplet discharge head 7 when ambient temperature is 20° C. By correspondingly comparing respective voltages of discharging pulses of driving waveforms of 15° C. (see FIG. 6) and 20° C. with each other, voltage ratios are obtained as shown in FIG. 11B. Specifically, since a driving pulse P1 appears first and accordingly an ink dropping velocity is slow with a small amount of ink droplets, it barely impact on a velocity of a coalescence of ink droplets. Whereas, driving voltages of the respective ink droplet pulses P2, P4, and P5 of the 20° C. waveform, which impact on the velocity of the coalescence of ink droplets, range from about 92% to about 94% of those of 15° C. waveform so that the ink droplet velocity created by the 20° C. waveform is equivalent to that created by the 15° C. waveform. However, when the discharging pulse P3 is assigned a similar proportion, an amount of ink droplets increases. Thus, a ratio of a voltage of the discharge pulse P3 of 20° C. driving waveform to that of the 15° C. driving waveform is determined smaller (e.g. 78%) than those of the other discharge pulses, so that the amount of ink droplets of the coalescence is almost equivalent to that caused by the 15° C. driving waveform. In this way, to adjust an amount of the ink droplets the above-described driving waveform (e.g. the discharging pulse P3) is utilized, because an impact thereof on an ink droplet velocity of the coalescing of the ink droplets is week as when the above-described discharging pulse is deleted.

Figure 12:
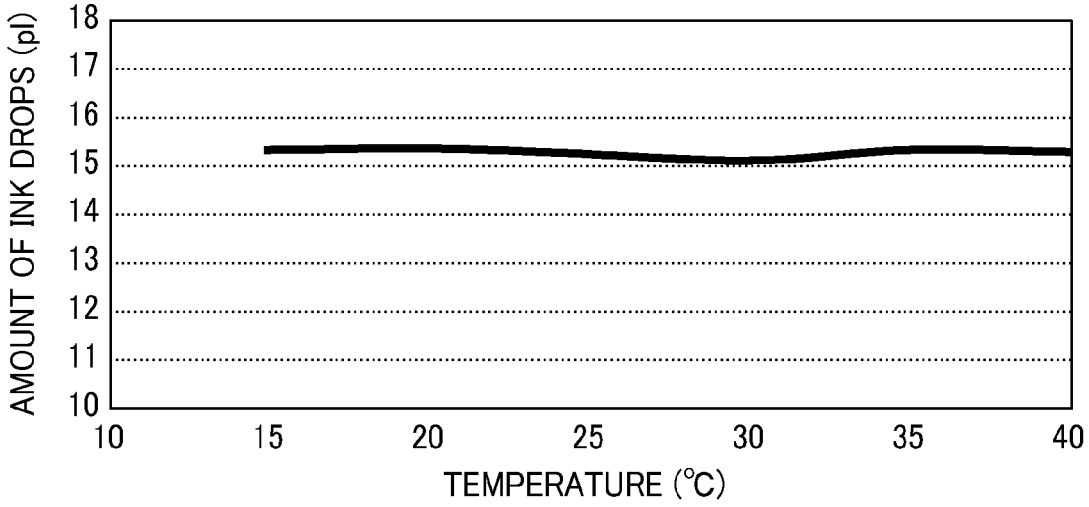
FIG. 12 is a diagram illustrating a relation between ambient temperature and an amount of ink droplets.

Hence, discharging of the ink droplet can be stabilized by employing the above-described driving waveform in accordance with an environment temperature according to this embodiment. Further, as shown in FIG. 12, an amount of ink droplets is about 15.2 pl±0.2 pl and is almost constant in an evaluation temperature range although it changes.

Hence, even though it is described based on a situation in which the number of discharge pulses is decreased by one according to one embodiment, the present invention is not limited thereto. For example, if a volume of ink droplets of 30 pl is generated by ten discharge pulses when temperature is low, the number of discharge pulses is decreased by two when the temperature is high. Whereas, the number of discharge pulses is decreased by one when the temperature is medium therebetween. In such a situation, a discharge pulse is omitted in an order from the end of the former ink droplet group. Conversely, when ambient temperature decreases, the number of discharging pulses can be increased correspondingly. Further, according to the embodiment of FIG. 11, although an amount of the ink droplets is finely adjusted by changing a voltage of the discharging pulse of the end of the former ink droplet group, the present invention is not limited thereto. For example, the amount of ink droplets can be finely adjusted by changing a descending time of a voltage of a discharging pulse of the tailing end of a former ink droplet group, or changing a holding time after descending the voltage. It is further executed by changing a rising time of the voltage of the discharging pulse. These are collectively referred to as an ink drop discharging adjustment in the present invention.

Further, in the embodiment of FIG. 11, beside the last driving pulse P5 of FIG. 6 serving as a pulling and shooting type waveform, a voltage descending portion is added to the end thereof as a vibration dumper to swell the pressure chamber 121 at a prescribed time to counteract and minimize residual vibration thereof that occurs when it shrinks and discharges an ink droplet.

Figure 13:
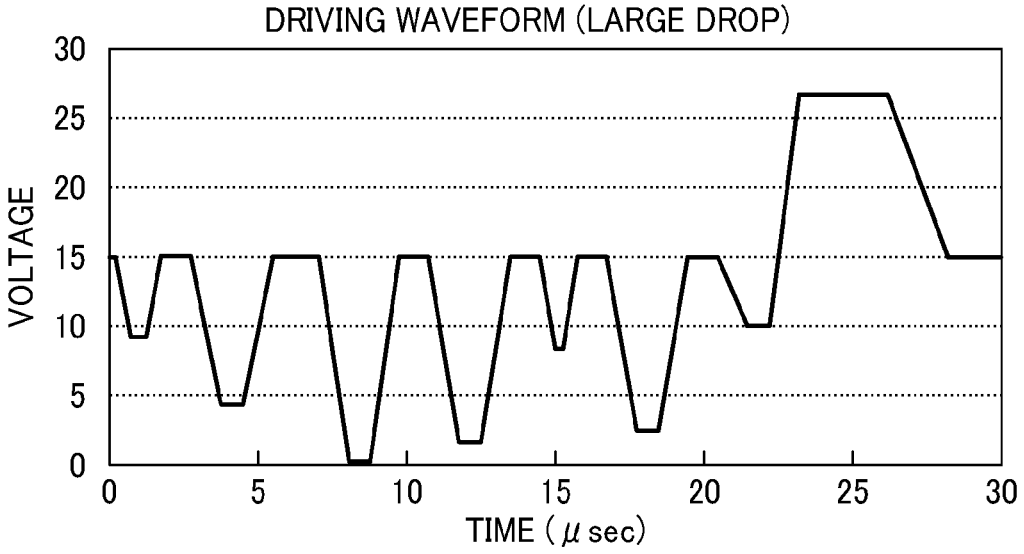
FIG. 13 is a chart indicating another driving waveform utilized in controlling the ink droplet discharge head according to one embodiment.
Figure 14:
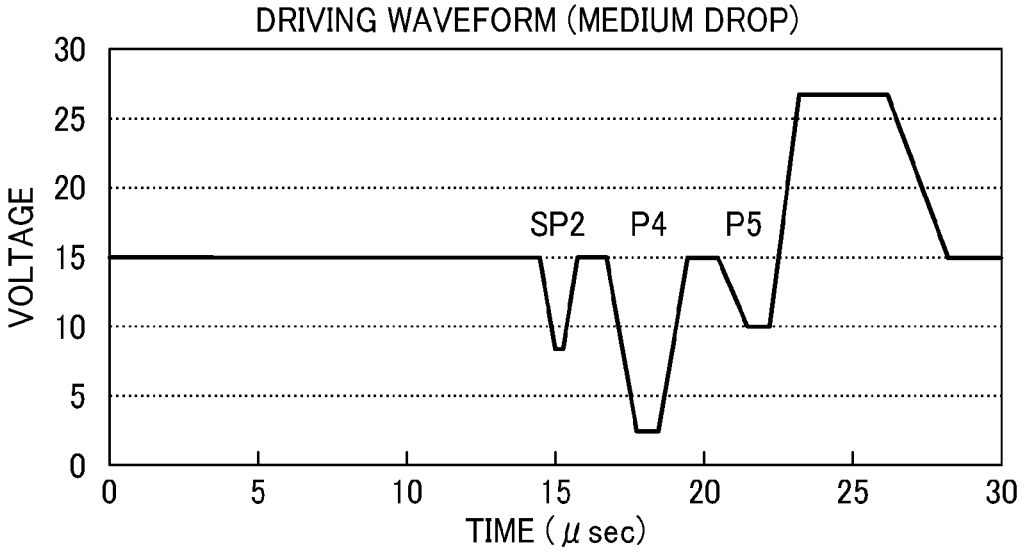
FIG. 14 is a chart indicating yet another driving waveform utilized in controlling the ink droplet discharge head according to one embodiment.

A driving waveform shown in FIG. 13 is equivalent to that of FIG. 6 and all of driving pulses therein is utilized. When a coalescence of ink droplets discharged by using the all of driving pulses is supposed to be a largest ink droplet, a medium-size ink droplet can be generated as a coalescence of ink droplets having a different size without increasing a length of the driving waveform by only using the driving pulses SP2, P4, and P5 that serves as a latter ink droplet group as shown FIG. 14. In such a situation, since the driving pulse P5 having the vibration damping portion as the last driving pulse in the driving waveform is utilized, damping effect can be obtained at the same time. Further, a stable medium-size ink droplet can be discharged without decreasing the maximum driving frequency.

Furthermore, the number of pulses is changed in accordance with printing density and a type of a sheet. Yet further, the above-described pulse waveform is selected by storing a correlation table indicating a correlation between temperature and a waveform in a non-volatile memory 204 provided in the control unit 200. For example, a waveform of FIG. 11A is selected and utilized when temperature is 20° C., and that of FIG. 10 is selected and utilized when temperature is 35° C., and so on. Further, a temperature sensor 215, such as a thermistor, etc., detects temperature, and the waveform is automatically selected based on the temperature. More specifically, the number of pulses can be changed in accordance with temperature, such that four pulses are utilized when temperature is 30° C., and six pulses are utilized when temperature is 10° C. supposing that five pulses are needed when temperature is 24° C. and an image is printed onto a plain sheet with 600×600 dpi (dot per inch). Further, the above-described various embodiments of the present invention can be applied to an ink-jet printer that discharges special liquid, such as colorant liquid used in a color filter of a LCD (Liquid Crystal Display), electrode material liquid forming an electrode of an organic EL (Electroluminescence) display or the like.

Hence, according to one embodiment of the present invention, an amount and a discharging velocity of a coalescence of ink droplets can be almost constant and the coalescence of ink droplets can be stable regardless of a change in ambient temperature. Because, to provide multiple ink droplet discharging pulses to a pressure generator per printing cycle and discharge ink droplets from an ink droplet discharge head in accordance with the number of multiple ink droplet discharging pulses, an ink-jet printing method implemented by an ink-jet printer comprises the steps of dividing the multiple ink droplet discharging pulses into two or more groups in an ink droplet discharging order, combining ink droplets with each other successively discharged in accordance with the number of multiple ink droplet discharging pulses of a former group as a first combined ink droplet before the ink droplets reach an adhering medium, and combining ink droplets with each other successively discharged in accordance with the number of multiple ink droplet discharging pulses of a latter group as a second combined ink droplet before the ink droplets reach the adhering medium. Further because, the method further comprises the steps of combining the second combined ink droplet with the first combined ink droplet ink droplet group before the ink droplets reach the adhering medium, and maintaining a prescribed amount of ink droplets landing on the adhering medium by decreasing the number of ink droplet discharging pulses by omitting the prescribed number of the ink droplet discharging pulses in the former group from the tailing end thereof in accordance with temperature increase.

According to another embodiment, a volume of an ink droplet can be more precisely equalized while suppressing an impact on discharging performance. Because, the ink-jet printing method comprises the step of maintaining a prescribed amount of ink droplets landing on the adhering medium by adjusting the discharge pulse located at the tail end of the former group in accordance with temperature increase.

According to yet another embodiment, a velocity of an ink droplet of the latter ink droplet group can be increased when it is united to the former ink droplet group, and the former and latter ink droplet groups are more precisely combined with each other. Because, the ink-jet printing method comprises the step of arranging a fine vibration pulse not to discharge an ink droplet but vibrate an ink meniscus at a position where the ink droplet discharging pulse is omitted in the former group. Further because, an interval between the fine vibration pulse and a first pulse in the latter group substantially corresponds to a natural vibration cycle Tc determined based on a condition of a passage of the ink droplet discharge head.

According to yet another embodiment, a dot having various sizes can be obtained without elongating the driving waveform beside the largest ink droplet. Because, an ink-jet printer comprises an ink droplet discharge head to discharge ink droplets, a head drive controller to provide multiple ink droplet discharging pulses composed of two or more successive groups in an ink droplet discharging order to the ink droplet discharge head per printing cycle and operate the ink droplet discharge head based on the multiple ink droplet discharging pulses, and an ink droplet discharge controller to control the ink droplet discharge head to discharge and combine ink droplets with each other discharged based on the former group of the multiple ink droplet discharging pulses as a first combined ink droplet before the ink droplets reach an adhering medium and combine ink droplets with each other successively discharged based on the latter group of the multiple ink droplet discharging pulses as a second combined ink droplet before the ink droplets reach an adhering medium. Further because, the ink droplet discharge controller controls the ink droplet discharge head to combine the second combined ink droplet with the first combined ink droplet before the ink droplets reach the adhering medium. Further because, a pulse number adjuster is provided to decrease the number of discharging pulses by omitting the prescribed number of the ink droplet discharging pulses from the tailing end in the former group in accordance with temperature increase.

Numerous additional modifications and variations of the present invention are possible in light of the above teachings. It is therefore to be understood that within the scope of the appended claims, the present invention may be practiced otherwise than as specifically described herein.

What is claimed is:

1. An ink-jet printing method implemented by an ink-jet printer having an ink droplet discharge head including a pressure generator, the method comprising the steps of:

dividing multiple ink droplet discharging pulses into two or more groups in an ink droplet discharging order;

providing the multiple ink droplet discharging pulses to the pressure generator per scan line time;

discharging ink droplets from the ink droplet discharge head in accordance with the multiple ink droplet discharging pulses;

combining successively discharged ink droplets with each other in accordance with the multiple ink droplet discharging pulses of a former group as a first combined ink droplet before the ink droplets reach a target;

combining successively discharged ink droplets with each other in accordance with the multiple ink droplet discharging pulses of a latter group as a second combined ink droplet before the ink droplets reach the target;

combining the second combined ink droplet with the first combined ink droplet before the ink droplets reach the target; and maintaining a prescribed amount of ink droplets landing on the target by decreasing the number of ink droplet discharging pulses by omitting the prescribed number of the ink droplet discharging pulses in the former group from the tailing end thereof in accordance with ambient temperature.

2. The ink-jet printing method as claimed in claim 1, further comprising the step of arranging a fine vibration pulse weak enough not to discharge an ink droplet but strong enough to vibrate an ink meniscus at a position where the ink droplet discharging pulse is omitted from the former group, wherein an interval between the fine vibration pulse and a first pulse in the latter group substantially corresponds to a natural vibration cycle Tc determined by a condition of a passage of the ink droplet discharge head.

3. An ink-jet printing method implemented by an ink-jet printer having an ink droplet discharge head including a pressure generator, the method comprising the steps of:

dividing multiple ink droplet discharging pulses into two or more groups in an ink droplet discharging order;

providing the multiple ink droplet discharging pulses to a pressure generator per scan line time;

discharging ink droplets from an ink droplet discharge head in accordance with the multiple ink droplet discharging pulses;

combining successively discharged ink droplets with each other in accordance with the multiple ink droplet discharging pulses of a former group as a first combined ink droplet before the ink droplets reach an target;

combining successively discharged ink droplets with each other in accordance with the multiple ink droplet discharging pulses of a latter group as a second combined ink droplet before the ink droplets reach the target;

combining the second combined ink droplet with the first combined ink droplet before the ink droplets reach the target; and maintaining a prescribed amount of ink droplets landing on the target by adjusting an amount of ink droplet discharged by a discharge pulse located at the tail end of the former group in accordance with ambient temperature.

4. An ink-jet printer to maintain a prescribed amount of ink droplets landing on a target, the printer comprising:

an ink droplet discharge head to discharge ink droplets;

a head driving controller to provide multiple ink droplet discharging pulses to the ink droplet discharge head per scan line time and operate the ink droplet discharge head based on the multiple ink droplet discharging pulses, the multiple ink droplet discharging pulses composed of two or more successive groups in an ink droplet discharging order;

an ink droplet discharge controller to control the ink droplet discharge head to discharge and combine ink droplets with each other discharged based on the former group of the multiple ink droplet discharging pulses as a first combined ink droplet before the ink droplets reach an target, and combine ink droplets with each other successively discharged based on the latter group of the multiple ink droplet discharging pulses as a second combined ink droplet before the ink droplets reach an target, the ink droplet discharge controller further controlling the ink droplet discharge head to combine the second combined ink droplet with the first combined ink droplet before the ink droplets reach the target; and a pulse number adjuster to decrease the number of discharging pulses by omitting a prescribed number of the multiple ink droplet discharging pulses from the tailing end in the former group in accordance with ambient temperature.

5. The ink-jet printer as claimed in claim 4, wherein the head driving controller arranges a fine vibration pulse weak enough not to discharge an ink droplet but strong enough to vibrate an ink meniscus at a position where the ink droplet discharging pulse is omitted from the former group, wherein an interval between the fine vibration pulse and a first pulse in the latter group substantially corresponds to a natural vibration cycle Tc determined by a condition of a passage of the ink droplet discharge head.

* * * * *